US007692542B2

(12) United States Patent
Outzs

(10) Patent No.: US 7,692,542 B2
(45) Date of Patent: Apr. 6, 2010

(54) DOOR POSITION MONITOR

(75) Inventor: Allan Harry Outzs, Mountain View, CA (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 448 days.

(21) Appl. No.: 11/819,548

(22) Filed: Jun. 28, 2007

(65) Prior Publication Data

US 2008/0012705 A1 Jan. 17, 2008

Related U.S. Application Data

(60) Provisional application No. 60/830,848, filed on Jul. 14, 2006.

(51) Int. Cl.
*G08B 13/08* (2006.01)

(52) U.S. Cl. ..... 340/547; 340/540; 340/545.1

(58) Field of Classification Search ..... 340/547
See application file for complete search history.

(56) References Cited

U.S. PATENT DOCUMENTS 3,704,460 A * 11/1972 Frank ..... 340/542
4,040,381 A * 8/1977 Keogh et al. ..... 116/86
4,210,889 A * 7/1980 Holce ..... 335/207
4,562,664 A 1/1986 Kambic
4,700,163 A * 10/1987 Wolfe, Jr. ..... 335/205
4,848,812 A * 7/1989 Slaughter ..... 292/144
4,916,267 A 4/1990 Lasier et al.
5,821,870 A * 10/1998 Jackson, Jr. ..... 340/687
6,249,224 B1 * 6/2001 Shoen et al. ..... 340/545.2
7,259,647 B2 * 8/2007 Gilmore ..... 335/205
2006/0192676 A1 * 8/2006 Vogt ..... 340/547
2007/0075859 A1 * 4/2007 Garavuso et al. ..... 340/547
2007/0139195 A1 * 6/2007 Jin et al. ..... 340/547

OTHER PUBLICATIONS

Material on Wireless Status Monitor http://www.wyrelessaccess.com/WSM.shtml, 2003.

* cited by examiner

*Primary Examiner*—Daniel Wu
*Assistant Examiner*—Naomi Small
(74) *Attorney, Agent, or Firm*—Baker & Daniels LLP

(57) ABSTRACT

A door position monitoring mechanism mounted in the edge of a door that senses whether a door is opened or closed by sensing the absence or presence of a magnetic field of a magnet that is mounted in the door frame. Information regarding the door position is then transmitted to a battery operated wireless access control system mounted on the same door through wires extending from the door position monitoring mechanism.

6 Claims, 3 Drawing Sheets

DSI SECURITY DEVICES

DSI SECURITY DEVICES

1/4-28UNF

Ø.204
7
1.50
120°
.49
40
080
7
82°
045

LOCATION OF LAST
FULL #8-32 THREAD
40
50

#8-32UNC
.070
Ø.46
Ø.169
Ø.136 THRU

DOOR POSITION MONITOR

CROSS REFERENCE TO RELATED APPLICATIONS

This application claims priority to and the benefits of U.S. Provisional Application No. 60,830,848, filed Jul. 14, 2006.

STATEMENT REGARDING FEDERALLY SPONSORED RESEARCH OR DEVELOPMENT

Not Applicable.

SEQUENTIAL LISTING

Not Applicable.

BACKGROUND OF THE INVENTION

The present invention relates to a door position monitoring mechanism, such as the type employed in university buildings and large office buildings or the like and more specifically to an improved wireless door position monitoring mechanism.

Universities and large office complexes or the like often employ monitoring apparatus on doors to monitor access into the buildings and the rooms therein. Accordingly, when it is desired to monitor a number of doors at any one time, it is desirable that a mechanism be attached to a door to detect whether the door is open or closed, and that this mechanism be capable of transmitting a signal indicating door position status to a display panel or the like to provide a correct indication as to the open or closed condition of each of the doors to be monitored. To attain the desired monitoring of the status of each door, various types of apparatus are used, which are responsive to door position and capable of providing a control signal in relation thereto.

In this regard, the prior art has several disadvantages and limitations. In general, the prior art has provided a monitoring mechanism which generally includes a monitoring system that is hard wired back to a host computer and is capable of controlling a limited number of doors generally ranging from 2, 4, 8, or 16 doors. If the end user wants to add a more doors than the monitor can handle (such as the 9th door for an 8-door controller), the end user must either physically remove and upgrade or replace the system as the system expands beyond the monitoring mechanism's designed capacity by buying an additional monitor and have it hard-wired back to the host computer. The present invention, in combination with a battery operated reading unit attached to the same door, eliminates the need of hard-wiring the door and hard-wiring back to the host computer.

Additionally, in prior art, the intelligence of the system generally rests in a controller and not at the door. Accordingly, if power is lost, the system falls back to fail-safe or fail-secure mode and data stored in the reader will be lost. The present invention when connected to a battery operated reading unit attached to the same door, reads and stores all system data at the reader unit attached to the door, and all data is stored at the door until power is restored to the system, at which time all information passes back through the network to the host computer.

Another disadvantage of the hard-wired systems typically found in the prior art is that these systems generally require an installer to drill holes to run wired cables to a card reader, run power back to a lock or strike, and wire door position contacts to install the door position switch. The present invention, on the other hand, may be installed at the screw hole location of a standard door latch and easily connected to battery operated reading unit and requires no drilling. Accordingly, the present invention advantageously greatly simplifies the installation procedure in this regard. That is, the present invention presents a mechanism in which the magnetic switch is built into a non-magnetic housing that attaches to the door and accepts a metal screw to secure the standard door latch to the door.

Accordingly, it is a general object of the invention to provide a novel and improved door position monitoring assembly. A more specific object is to provide a monitoring assembly in accordance with the foregoing object which is relatively simple in its installation, and highly reliable in its operation.

BRIEF DESCRIPTION OF THE PRIOR ART

U.S. Pat. No. 4,916,267 discloses a door closer mechanism that controls the opening and closing swing of a door in conjunction with a signal switch that electronically signals when the door is partially opened.

U.S. Pat. No. 4,562,664 discloses a door position monitoring assembly for a security door insulation wherein the assembly can be adjusted and preset from the exterior of the assembly.

SUMMARY OF THE INVENTION

The invention is assigned to OSI SECURITY DEVICES, INC., 1580 Jayken Way, Chula Vista, Calif.

The present invention discloses a door position monitoring mechanism. This invention has a magnetically actuated switch which is intended to be mounted in the edge of a door and sense whether the door is open or closed by sensing the absence or presence of the magnetic field of a magnet that is mounted in the door frame.

A magnetically actuated switch is mounted in a non-magnetic housing that has external threads for mounting the housing into the edge of the door at the door latch mounting screw location.

The housing also has an internal thread to accept a magnetically conductive set screw and a magnetically conductive screw for securing the door latch to the door. The set screw is inserted into the bottom of the internal threads to protect the magnetically actuated switch from damage in case an excessively long door latch mounting screw is installed. The magnetically conductive screw and the magnetically conductive set screw provide a path for the magnetic force generated by the magnet mounted in the door frame to activate the switch.

The magnet is mounted in the door frame behind a non-magnetic strike plate. Thus the magnetically actuated switch and magnet are hidden from view.

The mounting hole for the housing extends from the door edge into the opening for the lock body to provide a path for the switch wires which are subsequently connected to a signaling device.

Further areas of applicability of the present teachings will become apparent from the detailed description provided hereinafter. It should be understood that the detailed description and specific examples, while indicating the particular embodiments of the present teachings, are intended for purposes of illustration only and are not intended to limit the scope of the invention.

DETAILED DESCRIPTION OF SOME EMBODIMENTS OF THE INVENTION

Figure 1:
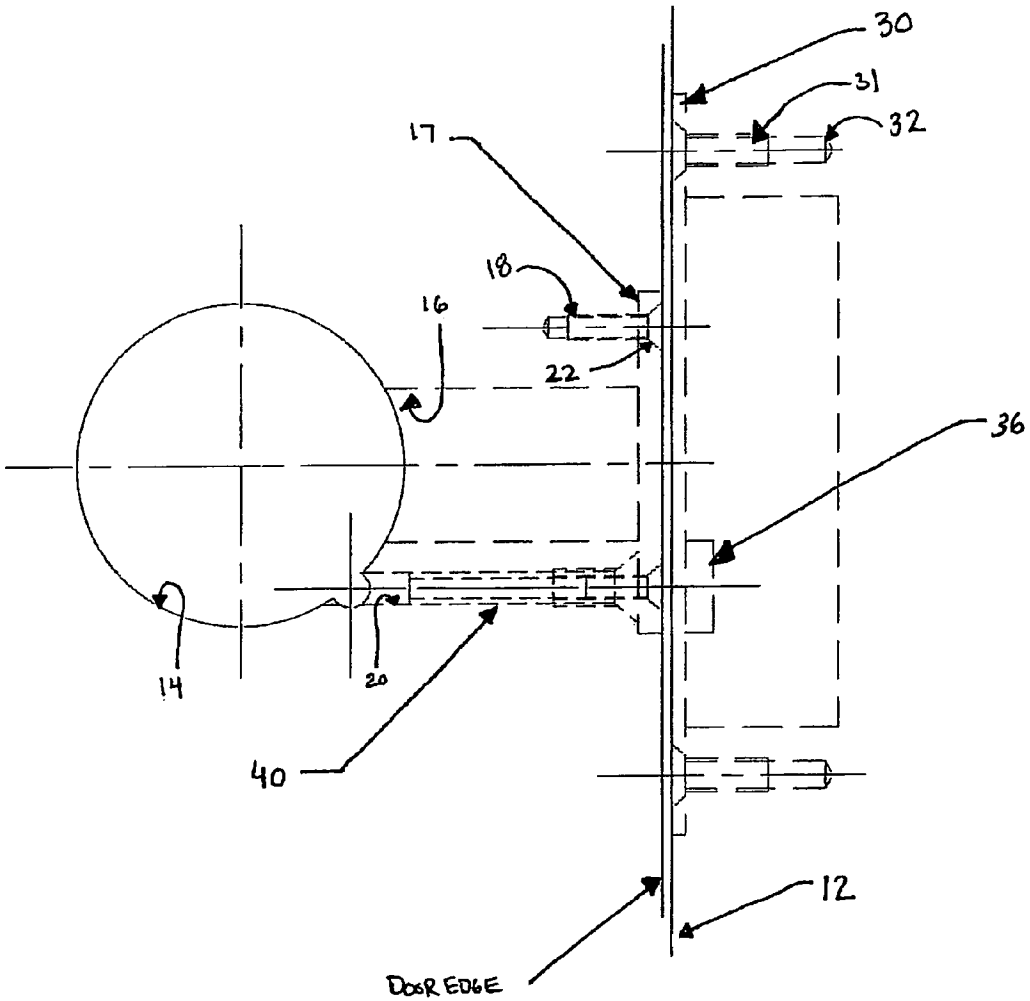
FIG. 1 is a schematic front elevation view showing the door position monitoring assembly mounted in a door and a door frame.

FIG. 1 discloses a door 10 and a door frame 12. A door lock assembly cutout 14 having a bore 16 are formed in door 10. A latch plate 17 is recessed in the right edge of door 10. Bore holes 18 and 20 are aligned with apertures in latch plate 17. A screw 22 is threaded into bore 18. A tubular housing member 40 is inserted into bore 20. A non-magnetic strike plate 30 is mounted in a recess in the face of door frame 12. Non-magnetic strike plate 30 has an aperture 31 and a screw passes through. A magnet 36 is positioned close to or in contact with non-magnetic strike plate 30.

Figure 2:
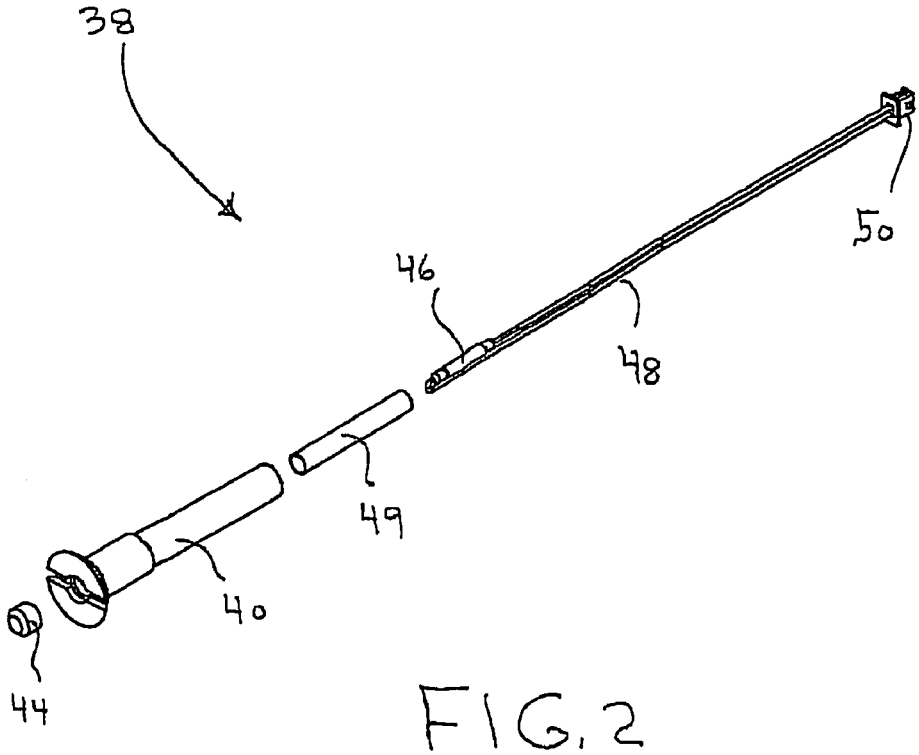
FIG. 2 is an exploded front perspective view of the door position monitoring assembly that is mounted in the door.
Figure 3:
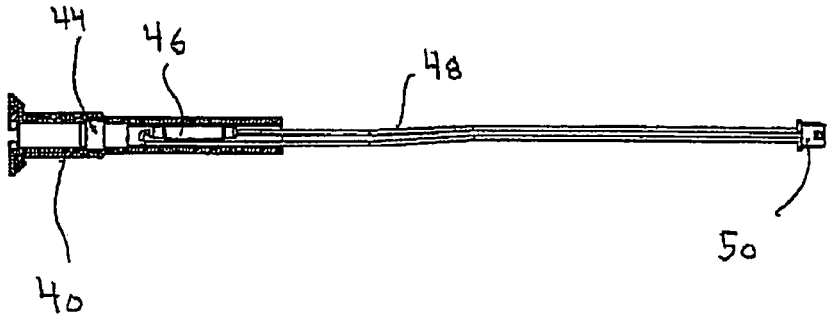
FIG. 3 is a schematic cross-sectional view of the door position monitor assembly.
Figures 4, 5, 6, 7:
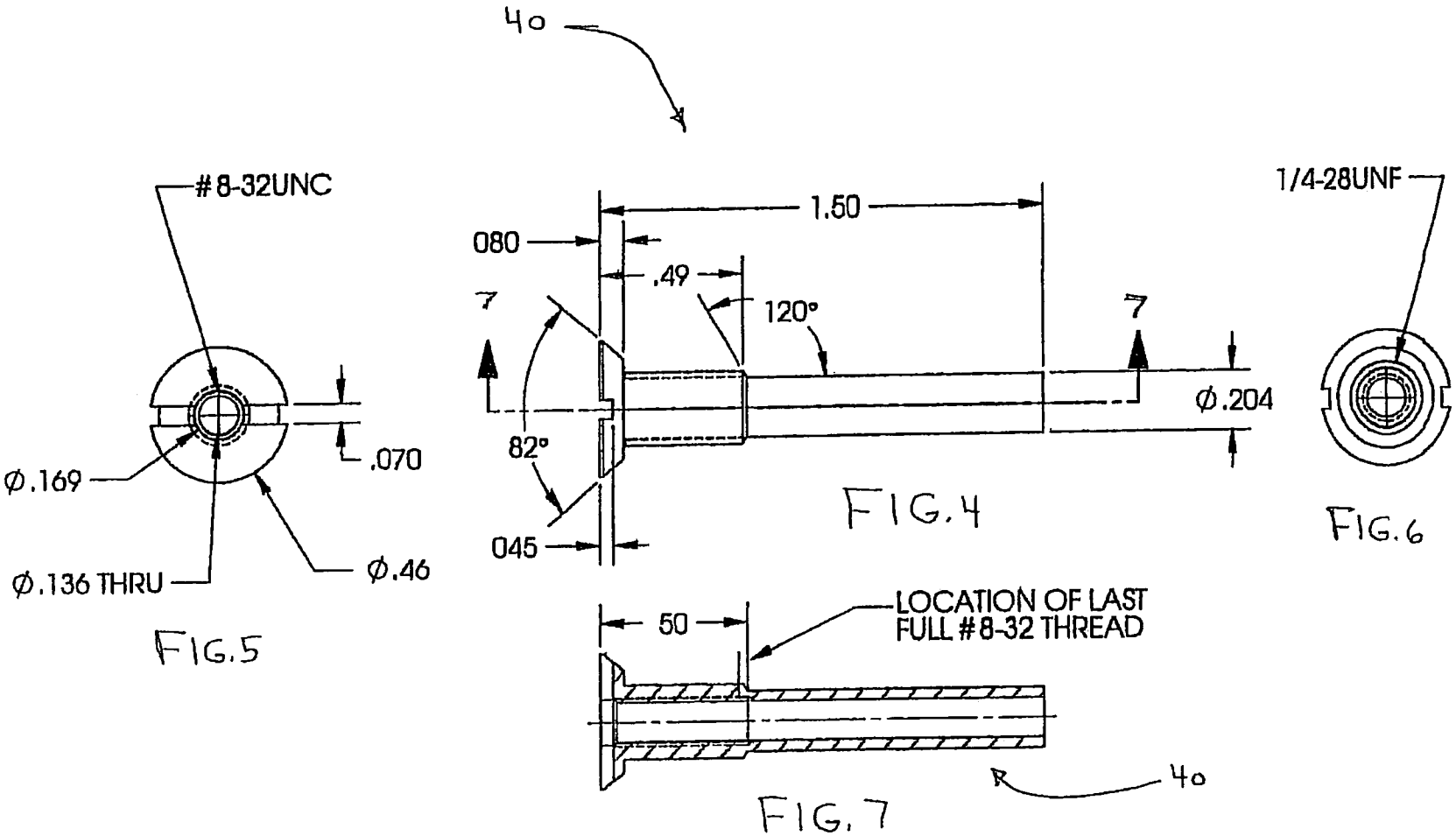
FIG. 4 is a side elevation view of the tubular housing member.
FIG. 5 is a front elevation view of the tubular housing member.
FIG. 6 is a rear elevation view of the tubular housing member.
FIG. 7 is a cross-sectional view taken along lines 7-7 of FIG. 4.

FIG. 2 is an exploded front perspective view of the assembly 38 mounted in bore 20 of door 10. Tubular housing member 40 is made of a non-conductive material and it has a bore 42 in its front end that receives a magnetically conductive set screw 44. The rear end of tubular housing member 40 has a bore that receives a magnetically actuated switch 46 that has a plastic tubing 49 shrunk thereon. Switch 46 is mounted in the rear end bore of tubular member 40. Wires 48 connect the ends of magnetic switch 46 to a sensor or signaling device 50. Sensor 50 provides a wired signal or wireless signal to a monitoring device that tells whether the door has closed or whether it remains open.

FIGS. 4-7 specifically disclose the structure of tubular housing member 40.

I claim:

1. A door position monitor system, comprising:

a magnet;

a magnetically conductive screw suitably adapted for securing a door latch to a door;

a magnetically conductive set screw;

a magnetically actuated switch;

a nonmagnetic tubular housing unit suitably adapted to being mounted into the edge of a door at door latch mounting screw location for mounting said magnetically actuated switch into a door wherein said nonmagnetic tubular housing unit is further suitably adapted to align said magnetically conductive screw, said magnetically conductive set screw, and said magnetically actuated switch with said magnet to create a path for the magnetic force generated from said magnet to activate said magnetically actuated switch and said nonmagnetic tubular housing unit comprises external threads for mounting said nonmagnetic tubular housing unit into the edge of the door at door latch mounting screw location, internal threads to accept said magnetically conductive set screw and said magnetically conductive screw, and means to receive said magnetically actuated switch in the rear end of said nonmagnetic tubular housing unit;

means for transmitting information, including information comprising the presence or absence of a magnetic field of said magnet mounted in a door frame, from said magnetically actuated switch to a sensor or signaling device; and means for protecting said magnetically actuated switch.

2. The door position monitor system of claim 1 wherein said magnet is mounted in a door frame and hidden from view behind a non-magnetic strike plate.

3. The door position monitor system of claim 1 wherein said means for protecting said magnetically actuated switch comprises inserting said magnetically conductive set screw into the bottom of the internal threads of said nonmagnetic tubular housing unit to protect said magnetically actuated switch from damage.

4. The door position monitor system of claim 1 wherein said magnetically conductive screw is inserted through an aperture in a door latch strike plate and into the internal threads of said nonmagnetic tubular housing unit.

5. The door position monitor system of claim 1 wherein said magnetically actuated switch has plastic tubing shrunk thereon and is mounted into the rear end of said nonmagnetic tubular housing unit.

6. The door position monitor system of claim 1 wherein said means for transmitting information comprises wires which connect to the end of said magnetically actuated switch and are suitably adapted to be connected to a signaling or sensor device.

* * * * *